US005354136A

United States Patent [19]

Takizawa et al.

[11] Patent Number: 5,354,136

[45] Date of Patent: Oct. 11, 1994

[54] PRINTER FEED MECHANISM

[75] Inventors: Hiroshi Takizawa; Toshiaki Watanabe, both of Suwa, Japan

[73] Assignee: Seiko Epson Corporation, Tokyo, Japan

[21] Appl. No.: 961,553

[22] Filed: Oct. 14, 1992

[30] Foreign Application Priority Data

Oct. 14, 1991 [JP] Japan ..... 3-264308
Apr. 1, 1992 [JP] Japan ..... 4-79951

[51] Int. Cl.[5] ..... B41J 19/70

[52] U.S. Cl. ..... 400/185; 400/187; 400/314

[58] Field of Search ..... 400/185, 187, 314, 314.1, 400/320, 322, 328, 572, 323

[56] References Cited

U.S. PATENT DOCUMENTS

| | | | |
|---|---|---|---|
| 3,986,594 | 10/1976 | Kondur, Jr. | 400/185 |
| 4,030,588 | 6/1977 | Hanagata et al. | 400/185 |
| 4,259,026 | 3/1981 | Hanaoka et al. | 400/320 |
| 4,420,763 | 12/1983 | Cuel et al. | 400/185 |
| 4,444,521 | 4/1984 | Rickard et al. | 400/185 |
| 4,565,461 | 1/1986 | Usui et al. | 400/611 |
| 4,920,258 | 4/1990 | Saito | 346/134 |
| 4,932,799 | 6/1990 | Schmeykal et al. | 400/187 |
| 5,090,827 | 2/1992 | Hirano et al. | 400/185 |
| 5,106,216 | 4/1992 | Kim | 400/185 |
| 5,136,308 | 8/1992 | Saito et al. | 400/185 |
| 5,140,344 | 8/1992 | Tsukada et al. | 400/185 |
| 5,226,743 | 7/1993 | Jackson et al. | 400/185 |

FOREIGN PATENT DOCUMENTS

| | | |
|---|---|---|
| 52669 | 3/1984 | Japan . |
| 122572 | 5/1988 | Japan . |
| 187380 | 3/1989 | Japan . |
| 50715 | 8/1991 | Japan . |
| 206847 | 1/1989 | United Kingdom . |

*Primary Examiner*—Eugene H. Eickholt
*Attorney, Agent, or Firm*—Eric B. Janofsky

[57] ABSTRACT

A highly reliable, low-noise, printer for providing good print quality while configured to print and feed paper using a single motor. A cam mechanism is used to provide simplified control over paper feeding operations. A print head carriage is driven by a belt drive gear assembly that also drives the paper feed cam directly. A paper feed roller is rotated by a drive lever assembly which interacts with a first cam profile formed on a surface of the paper feed cam, and the resulting torque is controlled by a contact release mechanism driven by interaction with a second cam profile also formed on a surface of the paper feed cam.

15 Claims, 12 Drawing Sheets

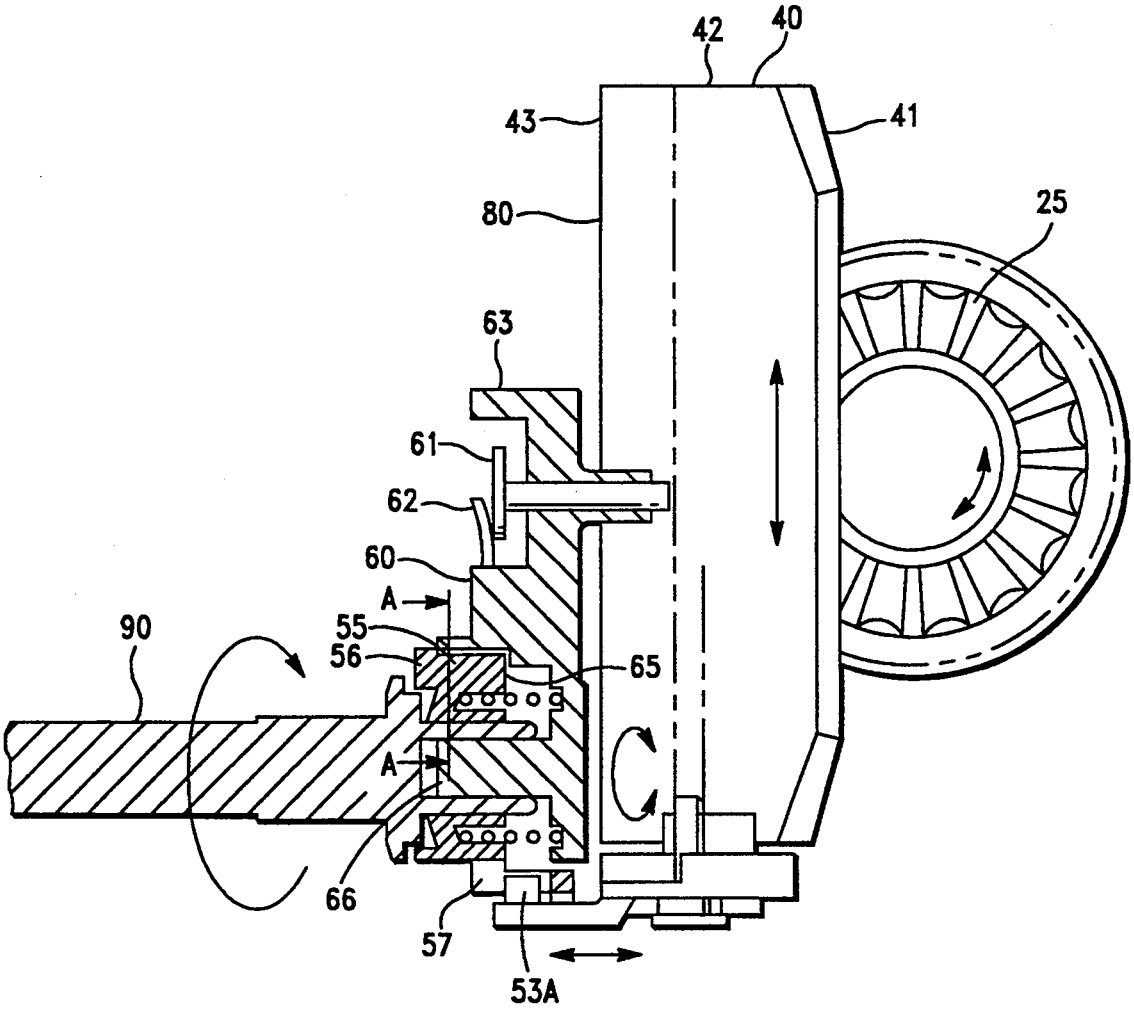
FIG.-4
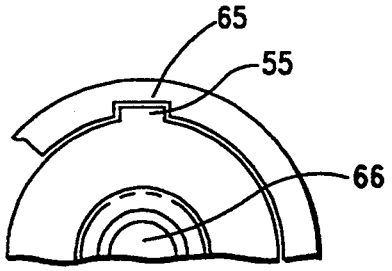
A-A

PRINTER FEED MECHANISM

BACKGROUND OF THE INVENTION

1. Field of the Invention

The present invention generally relates to printers that produce printed characters and graphics by moving a print head along a fixed line across the surface of a print medium, such as paper, and more particularly to a control method and structure for moving the print medium past the print head. The invention further relates to a mechanism for correlating the print medium advancement distance with preselected print modes.

2. Related Technical Art

One type of printer found in the art is a two-motor type printer that uses one motor as a dedicated driver for moving a carriage on which the print head is mounted, and the other as a dedicated driver for a feeding mechanism for paper or other print media. In this type of printer, each motor is controlled independently, allowing carriage movement distances to be freely selected depending only on the desired length for the printed line, and paper feeding is performed without being affected by carriage operation.

Another type of printer commonly found in the art is that of a serial printer that also drives a paper feed mechanism using the drive mechanism for the print head. In this type of printer, the paper is advanced when each carriage return occurs.

One variation on serial printers is shown in FIGS. 14 and 15, and disclosed in Japanese Laid-Open Patent Publication 3-50715 which shows a printer that facilitates adjustments to the amount of paper advance or feeding, and also adds a fast feed feature. In FIGS. 14 and 15, a printer 1 is shown using a helical cam 3, with a helical cam profile 2 formed on its surface, to drive a thermal type print head 4. Print head 4 is supported by, and moves along, a main guide shaft 7 parallel to a platen which supports the print medium. Groove-shaped cam profiles 5 and 6 are formed on guide shaft 7 for driving paper feeding operations. When print head 4 is positioned on the left end of main guide shaft 7, a pin, not shown, mounted under head 4 engages and interacts with cam profile 5 or 6, by pushing against one side of the groove-shaped profile, and causes main guide shaft 7 to rotate a prescribed amount. The rotary motion of guide shaft 7 is transmitted through a gear on the end of the shaft to a paper feeder 8 which is also rotated, advancing paper over the platen, and past print head 4.

The relative physical relationship of groove-shaped cam profiles 5 and 6 on main guide shaft 7 are illustrated in the form of "cam lines" in FIG. 15. As shown in FIG. 15, two distinct profiles, 5 and 6, are provided on the surface of main guide shaft 7, and each is configured for different angles of rotation for the shaft. When print head 4 moves to the left end of shaft 7, the head pin, acting as a cam follower, transfers between cam profile 5 and cam profile 6. That is, in a character mode in which predesigned or preformed characters are printed and a relatively large fixed media movement is used to accommodate the area prescribed for such characters, print head 4 traverses print media in the region between left end position Q1 and right end position Q3, and main guide shaft 7 is rotated through a rotational angle $F_1$ by cam profile 5. A one-way clutch is used so that feeder 8 only rotates in one direction, the direction in which paper is fed, during movement of the carriage and does not counter-rotate when the print head moves between the Q1 and Q3 positions.

In graphics mode, however, the amount of paper movement or feeding is relatively smaller than in character mode since the image is being constructed from rows of finely spaced dots otherwise used to form characters. In this mode, head 4 reciprocates between left end Q1 and right end position Q4, and the head pin moves between cam profile 5 and cam profile 6, so that as print head 4 returns to position Q1, main guide shaft 7 is only rotated through a rotational angle $F_2$, where $F_2 < F_1$. When print head 4 moves between positions Q1 and Q2, the pin transfers along a shallow groove-shaped interconnection cam profile 9 from cam profile 6 to cam profile 5, which is relatively deeper than cam profile 6.

In addition, in this particular type of printer, fast media feeding is made possible by reciprocating head 4 between positions Q1 and Q2. In this manner, the prior art printer shown in FIG. 14 uses only one motor as a dedicated power source both for moving print head 4 and feeding paper. This structure makes it possible to obtain a compact, lightweight printer. Also, since the paper feeding distance is adjustable, this type of printer mechanism accommodates a graphics mode as well as a character mode, providing additional advantages.

However, the printers available in the art have exhibited several disadvantages. Two-motor printers require simultaneous control of the respective motors for moving the print head and feeding the paper, which complicates the printer control system and makes it difficult to achieve a compact and lightweight printer at reduced cost. Serial printers can be made compact, lightweight, and at low cost, but are difficult to add functions to so that the amount of paper fed for graphics and other modes can be switched, or for providing fast feeding, etc.

Printers using groove-shaped cams that engage a paper carriage can also experience external forces due to variations in the frictional force exerted between the pin on the print head and the sides of the groove-shaped cam follower, etc. Such forces, and variations, are transmitted directly to the print head, affecting the speed with which the print head moves, and degrading print quality. The necessity of machining a groove in a long, cylindrical, main guide shaft, requires more time and precision for machining parts, making it difficult to lower costs. The spring loaded latch in the one-way clutch, also generally causes noise when the shaft is rotated in reverse during a part of the head movement.

Furthermore, when using a spring actuated one-way clutch, the magnitude of the spring force used to urge a drive element against a driven element is very critical. If this force is too weak, sufficient amounts of rotational force may or may not be transferred. If this force is too strong, counter rotation in a direction in which the clutch should be disengaged may sometimes occur, and sound noise from any ratchet teeth might be increased. Therefore, the accuracy or precision with which paper is fed and the resulting printing quality for the prior art is not very high.

SUMMARY OF THE INVENTION

The above and other problems found in the art are solved by the present invention, and one of its purposes is to realize a lightweight, compact, highly reliable printer that performs high quality printing.

Another purpose of the invention is to achieve a printer allowing for simple control systems.

Yet another purpose of this invention is to increase the accuracy of paper feeding and the resulting print quality.

These and other purposes, objects, and advantages are realized in a printer that uses a single motor to drive both a carriage drive mechanism and a paper feed mechanism, and that prints on paper by moving a print head mounted on a carriage along a platen supporting paper, or other media, while the paper feed mechanism moves the paper over the platen. First and second cam mechanisms are also coupled to the motor as a drive source, with the first cam being connected to cause a rotating element to move back and forth with a reciprocating action, and the second cam being connected to a transmission control mechanism so as to transfer motion in one direction from the rotating element to the paper feed mechanism. This results in the print head carriage traversing across the paper which is advanced, line-by-line, in synchronization with the reciprocating action of the motor, and the print head.

In a further embodiment, the printer is manufactured using a single or common cam wheel in association with other linking elements as both the first and second cam mechanisms, so as to obtain both the desired rotation and transmission control from a single driving element.

In one embodiment, at least two cam profiles are employed on the surface of the first cam mechanism, a motor control device is used for rotating the motor either forward and backward, and a detector essentially determines the number of rotations, or number of rotation steps, of the motor armature. The amount of paper movement or advancement is altered by selecting one of the cam profiles according to the rotation of the motor, relative to a reference position of the motor.

Using the above configuration, the paper feed mechanism is not moved by direct interaction with the print head, but is instead driven directly by a cam mechanism connected to the drive source for the print head carriage. The control mechanism that only transmits unidirectional rotation to the paper feed mechanism is also driven by the same power source. Since the reciprocating movements of both the print head and the cam wheel of the cam mechanisms have a one-to-one correspondence, this configuration facilitates selection of the amount of paper movement to correspond with the range of print head movement. That is, the cam member on which the groove-shaped cam profile is formed, is driven by the motor, while the paper is advanced by the paper feed mechanism, which is driven by this cam. To facilitate changes in the distance the paper moves or advances, two or more interconnected paper feed cam profile grooves are provided on a surface of the cam member. In addition, these groove-shaped cam profiles are configured so that they are selected in response to the amount of rotation of the motor, which corresponds to the position of the print head. That is, selection is possible according to the lateral movement of the print head carriage.

The paper feed mechanism requires elements that only transmit unidirectional rotation motion, but by including a transmission control mechanism in the cam mechanism which utilizes both forward and reverse rotation of the motor, and is capable of selectively transmitting the direction of rotation, no other power is required and noise from sources such as one-way clutch ratchet assemblies is eliminated.

Furthermore, by using a configuration in which the cam profiles of the cam mechanism are specially designed, selectively switching the amount of paper feed in response to a desired application is also implemented without requiring another power source.

The selection process for the paper advancement distance is configured so that it can be altered according to the amount of reciprocating rotation of the motor, which corresponds to the amount of lateral movement of the carriage on which the printer head is mounted, since it is also driven by the motor. Not only can a specific amount of paper movement be selected by head position, but the paper can be automatically fed for more than one prescribed printing line when the carriage is returned, so that fast paper feeding can also be performed as desired.

In further embodiments, a belt drive mechanism is used for driving the print head carriage to prevent direct interaction between the carriage and the paper feed mechanism. This print quality is improved by arranging the linkage between the rotary member and the motor to not include the carriage. The elasticity and flexibility of a belt absorbs vibrations that might be caused by the paper feed mechanism, so that they are not transmitted to the carriage. Also, when the carriage is not used to drive a cam as in the prior art, it can smoothly slide along its guide shaft unaffected by the paper feeding function."

Other objects and attainments together with a fuller understanding of the invention will become apparent and appreciated by referring to the following description and claims taken in conjunction with the accompanying drawings in which like numbers refer to like parts.

BRIEF DESCRIPTION OF THE DRAWINGS

FIG. 4A illustrates details of the paper feed and transmission mechanisms for the printer of FIG. 1;

FIG. 4B illustrates a cross section taken along line 4A through a portion of the assembly of FIG. 4A;

DESCRIPTION OF THE PREFERRED EMBODIMENTS

Figure 1:
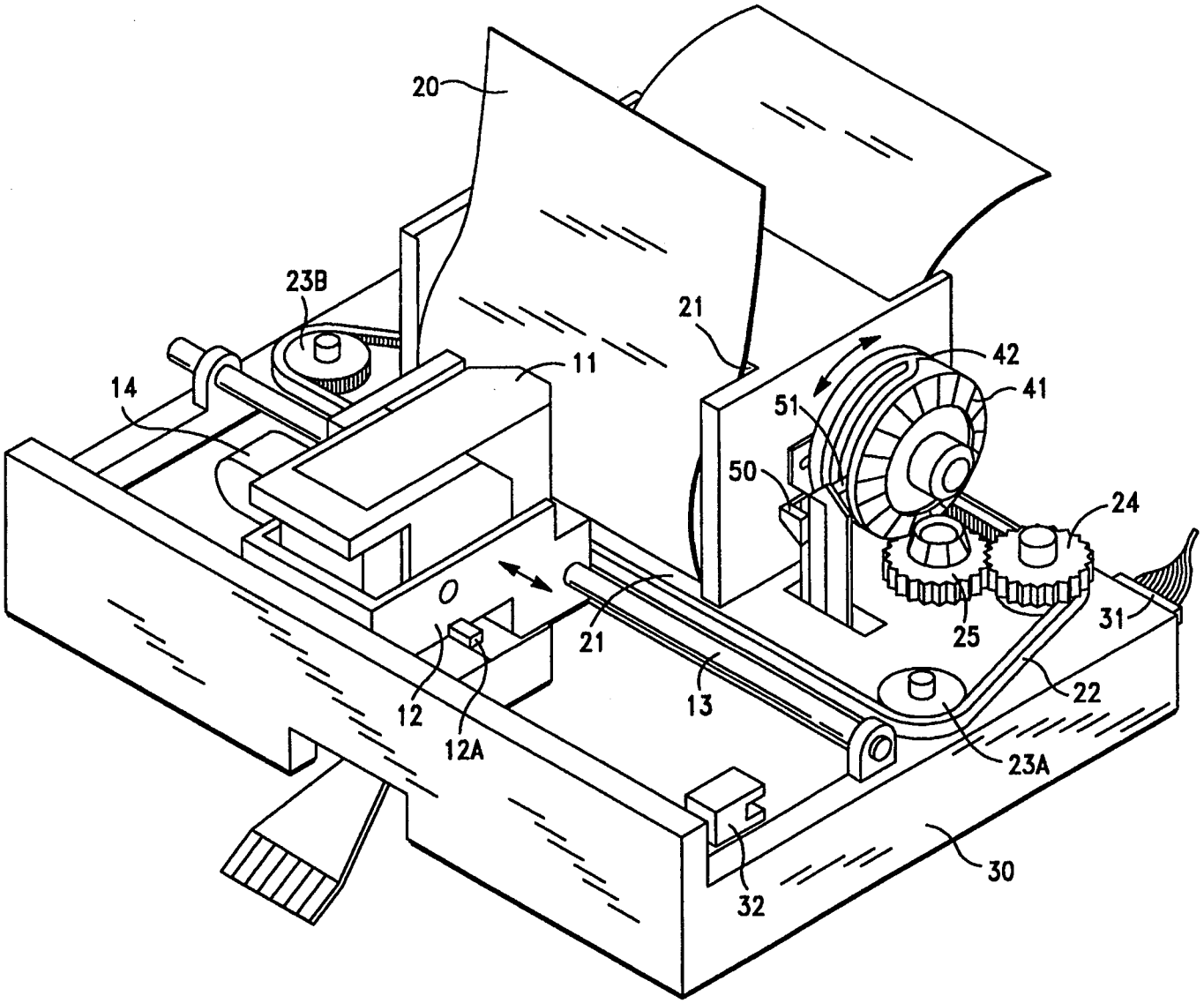
FIG. 1 illustrates a perspective view of one embodiment of a printer constructed and operating according of to the present invention.
Figure 2:
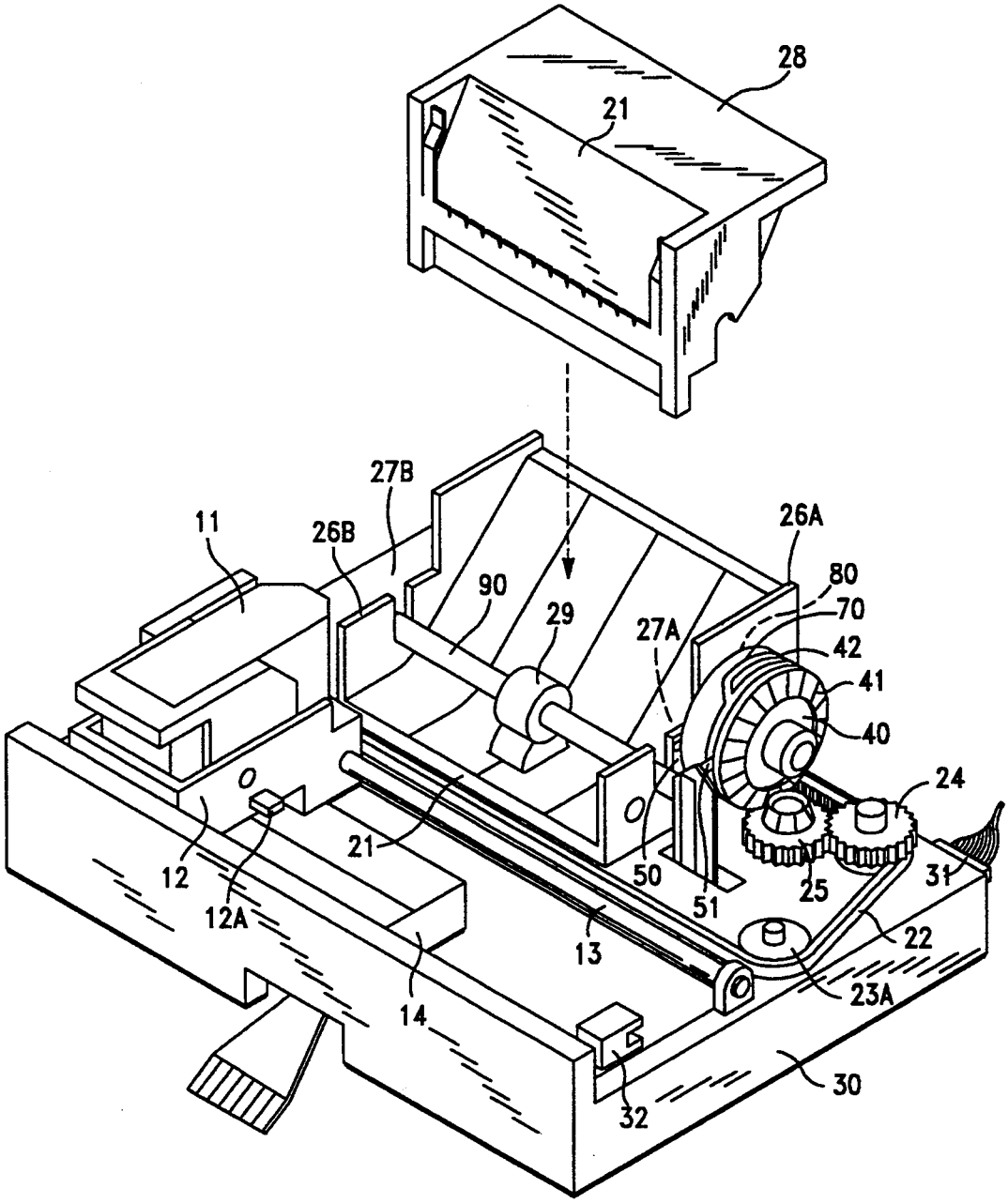
FIG. 2 illustrates an enlarged perspective view of the paper feed section of the printer of FIG. 1.
Figure 3:
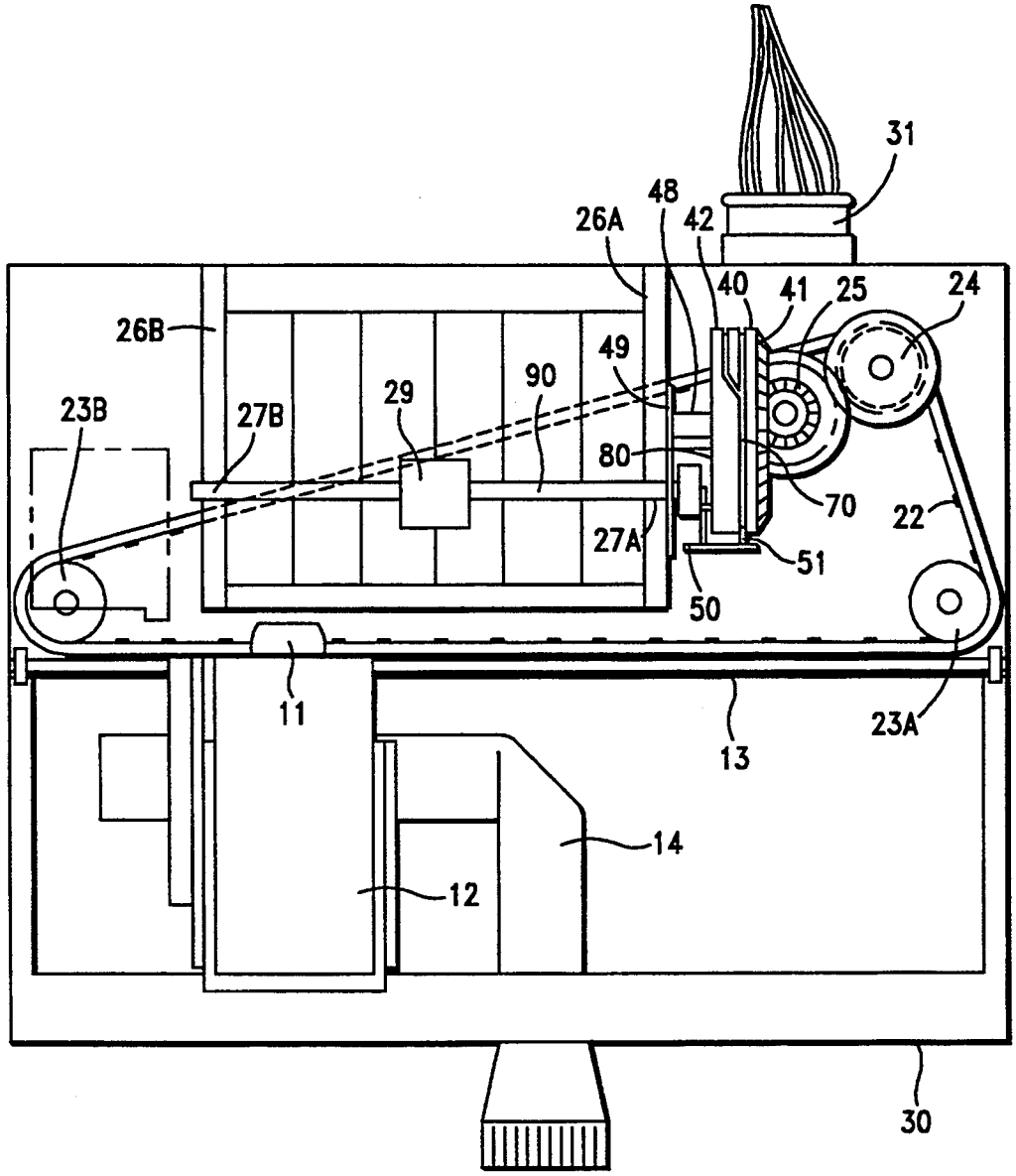
FIG. 3 illustrates a top plan view of the printer of FIG. 1.

Simplified diagrams of a first embodiment of a printer constructed and operating according to the present invention are illustrated in FIGS. 1, 2, and 3. In the embodiment of FIG. 1, a printer 10 is shown in which a print head 11, for example an ink jet type, is mounted on a print head carriage 12, which is supported by and moved along a main guide shaft 13. Main guide shaft 13 is positioned parallel to a platen 21 on which recording medium or paper 20 is supported during printing. Print head 11, being an ink jet type in this embodiment, performs dot matrix style printing in response to signals transferred over printed wiring 14, to which it is connected. Print head 11 prints in either a character mode, in which characters formed from predetermined arrangements of dots are printed, or a graphics mode, in which graphical images, etc., are formed from a series of dots.

Printer 10 utilizes a belt drive system to move or reciprocate carriage 12 on main guide shaft 13 across a base or support frame 30 of the printer. The belt drive system employs a timing belt 22 which has a series of gear teeth formed on one side, here the inside, and is secured along a portion to carriage 12. Timing belt 22 is positioned parallel to main guide shaft 13 and is mounted on a belt gear 24 and two pulleys 23*a* and 23*b*. A belt drive gear 25 turns belt gear 24 which in turn reciprocates timing belt 22 along main guide shaft 13. Belt drive gear 25 is positioned on base 30 adjacent to platen 21 and connected to a motor disposed on one corner of base 30 near main guide shaft 13. A connector 31 is mounted on printer 10, generally near the motor, and is used to transfer command signals to the motor.

A protrusion 12*a* is secured to carriage 12 and engages a home position sensor 32, making it possible to detect a reference position for either, or both, the print head or the motor.

Belt drive gear 25 also acts as a driver for the paper feed mechanism, and uses bevel-shaped gear teeth on one surface to interact with and turn a paper feed cam 40, which acts as a cam wheel. Since a bevel-shaped gear is used, paper feed cam 40 is driven to rotate about an axis that is perpendicular to the axis of rotation of belt drive gear 25. Paper feed cam 40 is supported by a cam shaft 48 protruding from a cam base 49 which is a plate-shaped member disposed on a side wall 26*a* of platen 21 toward belt drive gear 25.

As shown in FIGS. 2 and 3, paper feed cam 40 is coupled to and rotates a paper feed shaft 90 which is disposed inside a platen cover 28 where it is supported in shaft holes 27*a* and 27*b* formed in side walls 26*a* and 26*b*, respectively, of platen 21. A paper feed roller 29 is mounted on paper feed shaft 90 and interacts with a surface of the print media to advances or feed the media.

Paper feed cam 40 is formed as a disc-shaped element or on cylindrical surface, and has a bevel-shaped cam gear 41 formed on one surface, here the top surface. The teeth of cam gear 41 are configured to mesh with the teeth of bevel-shaped drive gear 25. A slot or groove-shaped cam profile 70 is formed on a cylindrical side surface 42 of paper feed cam 40. A shift lever pin 51 engages groove-shaped cam profile 70 as a cam follower and is used to control a rotating member 56 as part of a transmission control or clutch mechanism 50 to effect uni-directional transfer of rotational movement to paper feed roller 29.

Figure 5:
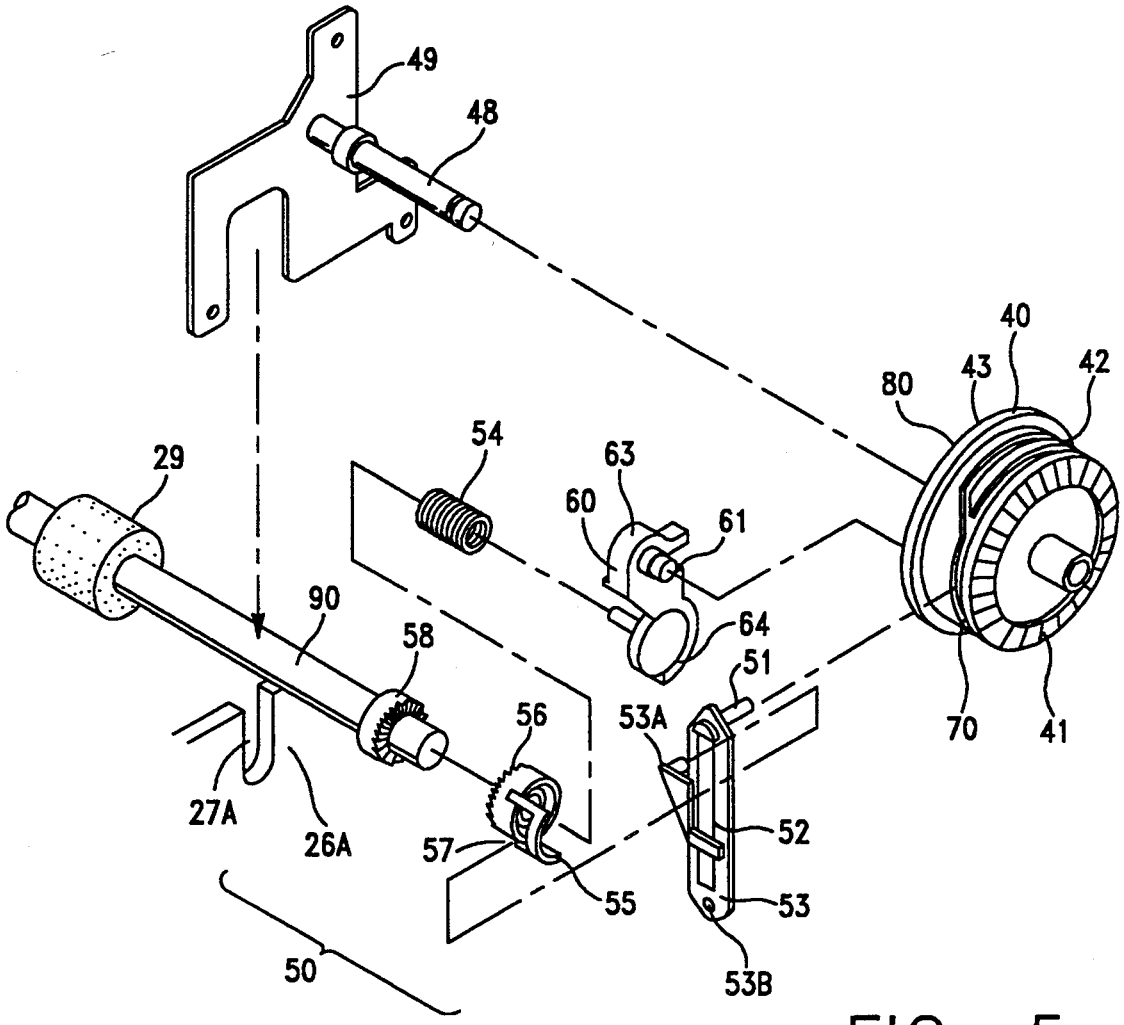
FIG. 5 illustrates an exploded diagram for some parts used in manufacturing the mechanisms of FIG. 4.

A more detailed view of both the paper feed and transmission mechanisms is shown in FIG. 4, while FIG. 5 shows how each of the components of these mechanisms are interconnected. As shown in FIGS. 4 and 5, transmission control mechanism 50 uses a lever 53, a spring 54, and a ratchet wheel 58, in addition to rotating member 56, which is referred to as ratchet wheel 56 below. The circumference or opposing disc surfaces of drive ratchet wheel 56 and ratchet wheel 58 are each manufactured in the shape of a teethed ratchet with a series of inclined teeth or "claws" formed in the shape of a crown. The claws or teeth on ratchet wheel 56 match those of ratchet wheel 58 but are inclined in the opposite direction so that they mesh with and reliably transfer rotational force to the opposing teeth of ratchet wheel 58. Ratchet wheel 58 is connected directly to paper feed shaft 90 and spring 54 presses drive ratchet wheel 56 against rotated ratchet wheel 58, to interlock their respective teeth. Shift lever 53 is used to connect and disconnect, or engage and disengage, drive ratchet wheel 56 from rotated ratchet wheel 58, and has a support tab or arm supporting a pin or rod 53*a* that extends toward drive ratchet wheel 56. A protruding member or tab 57 is formed on drive ratchet wheel 56 and has a hole or slot for receiving connection pin 53*a* which is used to move drive ratchet wheel 56.

Shift lever pin 51, which follows cam profile 70 on cam 40, is mounted on one end of shift lever 53. Pin 51 is biased outward from the surface of lever 53 using a spring 52, so that it extends adjacent to the bottom of cam profile 70. In this embodiment, this is accomplished by forming a retention element, such as a ridge or expanded base, on pin 51 and extending the pin through a hole in the end of lever 53 which is narrower than the retention element. Spring 52 is mounted to press against the bottom of pin 51 and force it to extend from lever 53 until the retention element is engaged. An exemplary spring 52 comprises a flat or leaf spring secured on the back side of lever 53. In the alternative, spring 52 may be formed as a coiled spring mounted in a depression or on a retention post near pin 51 with a short, straight, portion extending from one end that engages the end of pin 51. Those skilled in the art will readily understand the various techniques for mounting springs and their respective operation with pin 51.

As can be seen in FIGS. 4 and 5, shift lever pin 51 engages and traces the varying depth of cam profile 70 which causes shift lever 53 to be actuated by rotating about a pin extending through a shift lever anchor hole 53*b*. As shift lever 53 rotates about point 53*b*, pin 53*a* is moved laterally toward or away from ratchet wheel 58. The lateral motion of pin 53*a* serves to either engage or disengage drive ratchet wheel 56 from ratchet wheel 58, against the force of paper feed spring 54. That is, the movement of pin 51 in cam profile 70 results in transmission 50 either transferring or blocking the transfer of torque to paper feed shaft 90 and roller 29, thus forming a desired one-way clutch that transmits torque in only one direction. By using a shift lever that is capable of blocking torque as disclosed above, noise generated when drive ratchet and ratchet wheels 56 and 58 are rotated in reverse can be prevented, and reverse paper feeding which can readily occur at the time of reverse rotation as a result of surface friction, can also be prevented.

Figure 6:
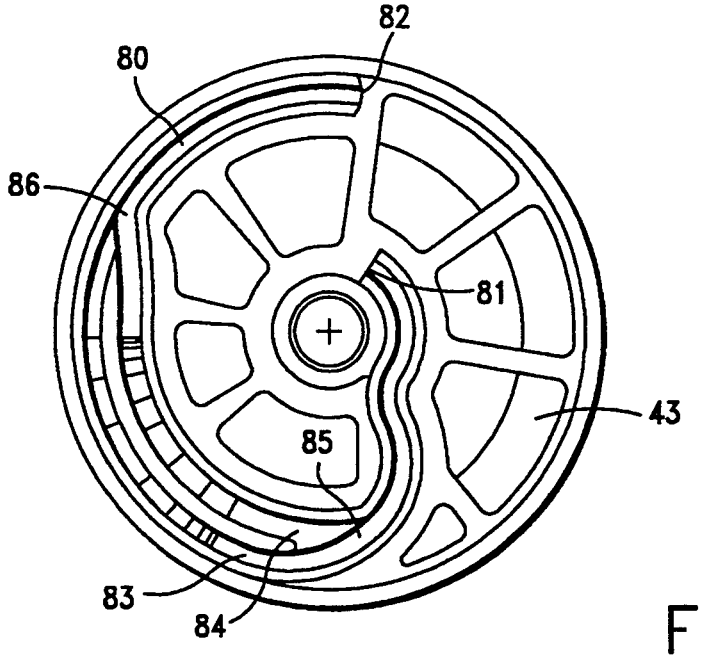
FIG. 6 illustrates a rear plan view of a groove-shaped cam profile useful for feeding paper.

A groove-shaped cam profile 80 is used for effecting paper feeding operations and is formed on a surface 43 of paper feed cam 40 on the opposite side from cam gear 41, here the rear surface. A paper feed lever pin 61 is connected to a control paper feed lever 60 and extends from lever 60 so as to engage cam profile 80 as a cam follower. A top plan view of the path or configuration of groove-shaped cam profile 80, on surface 43, is shown in FIG. 6.

As shown in FIGS. 4A and 5, paper feed lever 60 is used to drive paper feed shaft 90 through ratchet wheel 56 of transmission or clutch assembly 50. Paper feed lever 60 comprises a disc-shaped rotary transmission member or element 64 and a lever 63 formed as a single unit. A rotational shaft 66 is formed in transmission element 64. Lever 63 rotates freely about rotational shaft 66 which is inserted through a central opening in ratchet wheel 56 and preferably paper feed shaft 90. Shaft 66 also acts as a support shaft for ratchet wheel 56 while recess 65 acts as a cylindrical housing for both ratchet wheel 56 and spring 54. The disc-shaped rotary transmission element portion of paper feed lever 60 acts as a back stop for spring 54 as it presses against ratchet wheel 56.

At the same time, protrusion or extension 55 of ratchet wheel 56 interacts with rotary transmission element 64 so that rotary motion of lever 63 is translated to rotary motion of drive ratchet wheel 56. As illustrated in FIG. 4B, this interaction is accomplished by forming one or more recesses 65 in the walls of transmission element 64 and a matching ridge or extension 55 on the surface of ratchet wheel 56. Therefore, rotating lever 63 about shaft 66 causes rotary transmission element 64 to press against extension 55 and turn ratchet wheel 56.

In the alternative, those skilled in the art will readily understand that the outer surface of ratchet wheel 56 and the inner surface of recess 65 could have additional mating ridges, slots and keys, or gear teeth which act as slideably interconnected elements to transmit rotary motion while allowing ratchet wheel 56 to move in response to spring 54 or lever 53. One such exemplary embodiment uses gear teeth formed on the outer surface of ratchet wheel 56 to interact with gear teeth formed on transmission element 64.

A lever pin 61, which engages groove-shaped cam profile 80 cam 40, is mounted on the end of lever member 63 opposite transmission member 64. As in the case of pin 51, a spring 62 is used to press against lever pin 61 from the end opposite cam profile 80, so that it extends adjacent to the bottom surface of cam profile 80 so that lever pin 61 can accurately trace cam profile 80, whose depth varies. This can be accomplished by forming pin 61 with a retention element such as, but not limited to, a larger base portion or a circumferential ridge, and mounting spring 62 behind pin 61. As before, an exemplary spring 62 is a flat spring or in the alternative a coiled spring mounted in a depression or on a retention post adjacent to pin 61.

Since lever pin 61 traces cam profile 80, the end of paper feed lever 60 rotates between various radial positions, relative to the center of paper feed cam 40 as the paper feed cam rotates. This produces rotary motion of rotary transmission 64 about shaft 66 and rotation of ratchet wheel 56 about shaft 66 and rod 90. While lever 63 rotates drive ratchet wheel 56 in both directions, only rotation in one direction is transmitted to paper feed shaft 90 through ratchet wheel 58 in response to the clutch control exerted by shift lever 53. As rotary motion is applied to ratchet wheel 58 and, thus, paper feed rod 90, paper feed roller 29 advances paper 20 through the printer.

A rear side plan view of surface 43 of paper feed cam 40 is illustrated in FIG. 6. FIG. 6 shows the configuration or path of groove-shaped cam profile 80. Cam profile 80 extends in a generally spiral path from an inner radial end position 81 of paper feed cam 40 to an outer radial end position 82. Cam profile 80 comprises two groove-shaped cam profiles or sub-profiles 83 and 84. Cam profile 83 is formed as the outer most of the two cam profiles, and directs paper feeding when the printer operates in character mode, while cam profile 84 is formed as the inner most and directs paper feeding in graphics mode. Since cam profile 84 is formed interior to cam profile 83, the amount by which paper feed lever 60 is rotated in graphics mode is lower than for character mode. That is, the pin 61 end of lever 63 is moved through smaller radial changes in following cam profile 84 than in following cam profile 83, which results in a lower angle of rotation for level 63. Therefore, the amount by which paper is fed in graphics mode is less than in character mode. Cam profiles 83 and 84 intersect or form a single cam profile at connection points 85 and 86. This allows shift lever pin 61 to trace both cam profiles 83 and 84.

Cam profile 83 is formed so that it is deeper adjacent to inner end 81 and toward outer end 82. It then gradually becomes shallower toward the center of the profile path adjacent to connection point 85 with cam profile 84, and then rapidly increases in depth again after connection point 86 as it extends toward outside end 82. Cam profile 84 is formed so that it is deeper where it extends from outside end 82 past connection point 86 along an outer radial path. After connection point 86, it gradually decreases in depth or becomes shallower as it approaches connection point 85. It then quickly increases in depth after connection point 85 with cam profile 83 as it nears inner end 81.

Cam profiles 83 and 84 are configured to provide alternate guidance structures for pin 61 which correspond to alternate lateral movements of print head 12 along main shaft 13. That is, as print head 12 is moved along shaft 13 cam 40 is also turned by belt drive gear 25. The farther head 12 moves along the shaft the farther cam 40 is rotated and visa versa. Therefore, in character mode, paper feed cam 40 is rotated by the motor as print head carriage 12 is moved no more than a predetermined distance, and lever pin 61 traces deeper cam profile 83 starting at inner end 81. If the print head reverses direction along main shaft 13 before pin 61 reaches connection point 86, as paper feed cam 40 is rotated in the opposite direction by the motor and belt drive system, in synchronization with the reciprocating movement of the print head, lever pin 61 traces cam profile 83 in reverse and completes a paper line feed operation. This operation is considered a character mode operation because the outer cam profile is used, which imparts a larger rotary motion to lever 63 and rod 90.

In graphics mode, however, the motor is stepped or rotated farther so that the amount of carriage 12 movement is increased, which also results in a larger amount of rotation by paper feed cam 40. Therefore, if the motor rotates, and carriage 12 is moved, far enough, cam 40 is rotated so that lever pin 61 is moved past connection point 86 toward outer profile end 82. Then, when print head carriage 12 reverses direction and paper feed cam 40 rotates in reverse, lever pin 61 traces the deeper groove shape of cam profile 84 as it passes connection point 86 where profile 83 is shallowest. Therefore, in graphics mode, the inner cam profile 84 is selected and a smaller amount of rotary motion is imparted to level 63 and rod 90, resulting in a smaller amount of paper feeding being performed. This is a result of the variations in groove depth for the profiles and the fact that pin 51 is spring biased, allowing it to be deflected upward as the groove depth decreases, but extend rapidly when a deeper portion of the groove is encountered. Therefore, depth variations are used to redirect the path of pin 51.

Since cam profile 84 merges with cam profile 83 at connection point 85, paper feeding suitable to character mode or graphics mode is selected equally for the next line of printing, and only the motor rotation corresponding to the maximum movement of carriage 12 along shaft 13 changes the paper feeding. The operation of each mode is describe in more detail below.

Figure 7:
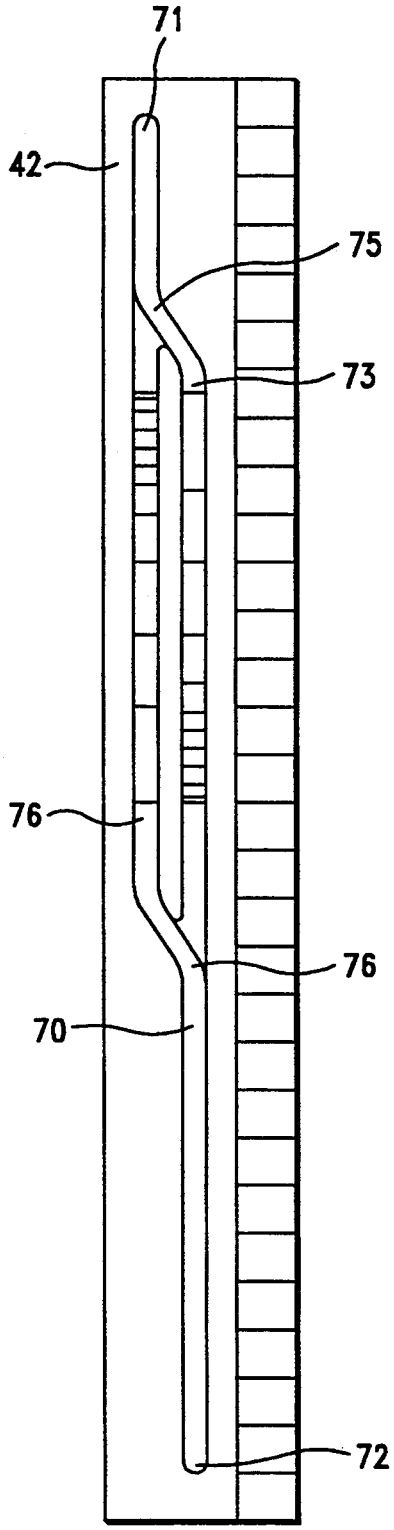
FIG. 7 illustrates a planar projection of a groove-shaped cam profile useful for shifting.

A planar projection of the surface 42 of feed cam 40 containing cam profile 70, as used for engaging or disengaging drive ratchet wheel 56, referred to as transmission shifting, is shown in FIG. 7. In FIG. 7, cam profile 70 comprises two cam profiles or sub-profiles 73 and 74 which extend between an end 71 where shift lever pin 51 is positioned when paper feed lever pin 61 is positioned at end position 81 of cam profile 80, and an end 72 at which lever pin 51 is positioned when paper feed lever pin 61 is positioned near end 82. Ends 71 and 72 represent different positions along the circumference of cam 40. Cam profiles 73 and 74 intersect or are interconnected at connection points 75 and 76, which are shown offset toward ends 71 and 72, respectively. Each cam profile 73 and 74 is configured to be engaged and traced by shift lever pin 51.

Groove-shaped cam profile 73 is formed so that it is deeper where it extends from end 71 past connection point 75, after which it gradually becomes shallower and then quickly increases in depth at connection point 76 where it merges with cam profile 74 and continues on until reaching end 72. Cam profile 74 is formed so as to be deeper from end 72 past connection point 76, after which it gradually becomes shallower and then quickly increases in depth at connection point 75, where it merges with cam profile 73 and continues on until reaching end 71. Using this configuration for cam profile 70, shift lever pin 51 first traces cam profile 73, but after it passes connection point 76 on the return trace, it traces cam profile 74, which is deeper near end 72. As before, this is a result of the variations in groove depth for the profiles and the fact that pin 51 is spring biased, allowing it to be deflected upward as the groove depth decreases, but extend rapidly when a deeper portion of the groove is encountered. Therefore, depth variations are used to redirect the path of pin 51.

The portion of cam profile 73 extending between connection point 75 and end 72 is formed generally parallel to an edge of surface 42 opposite or away from drive ratchet wheel 56. While shift lever pin 51 is engaged in cam profile 73, drive ratchet wheel 56 is shifted by shift lever 53 in a direction, toward cam 40, that compresses paper feed spring 54. In this configuration, drive ratchet wheel 56 separates or disengages from ratchet wheel 58, and torque applied by paper feed lever 60 (63, 64) is not transmitted to paper feed shaft 90. Cam profile 74 extends between connection point 76 and end 71, and is formed generally parallel to an edge of surface 42 on the drive ratchet wheel 56 side of paper feed cam 40. While shift lever pin 51 traces cam profile 74, spring 54 is allowed to extend against wheel 56, drive ratchet wheel 56 and rotated ratchet wheel 58 are inter-meshed or coupled together, and rotational torque is transmitted from paper feed lever 60 to paper feed shaft 90, thus feeding paper. Each of these modes are explained in more detail below.

Figure 8:
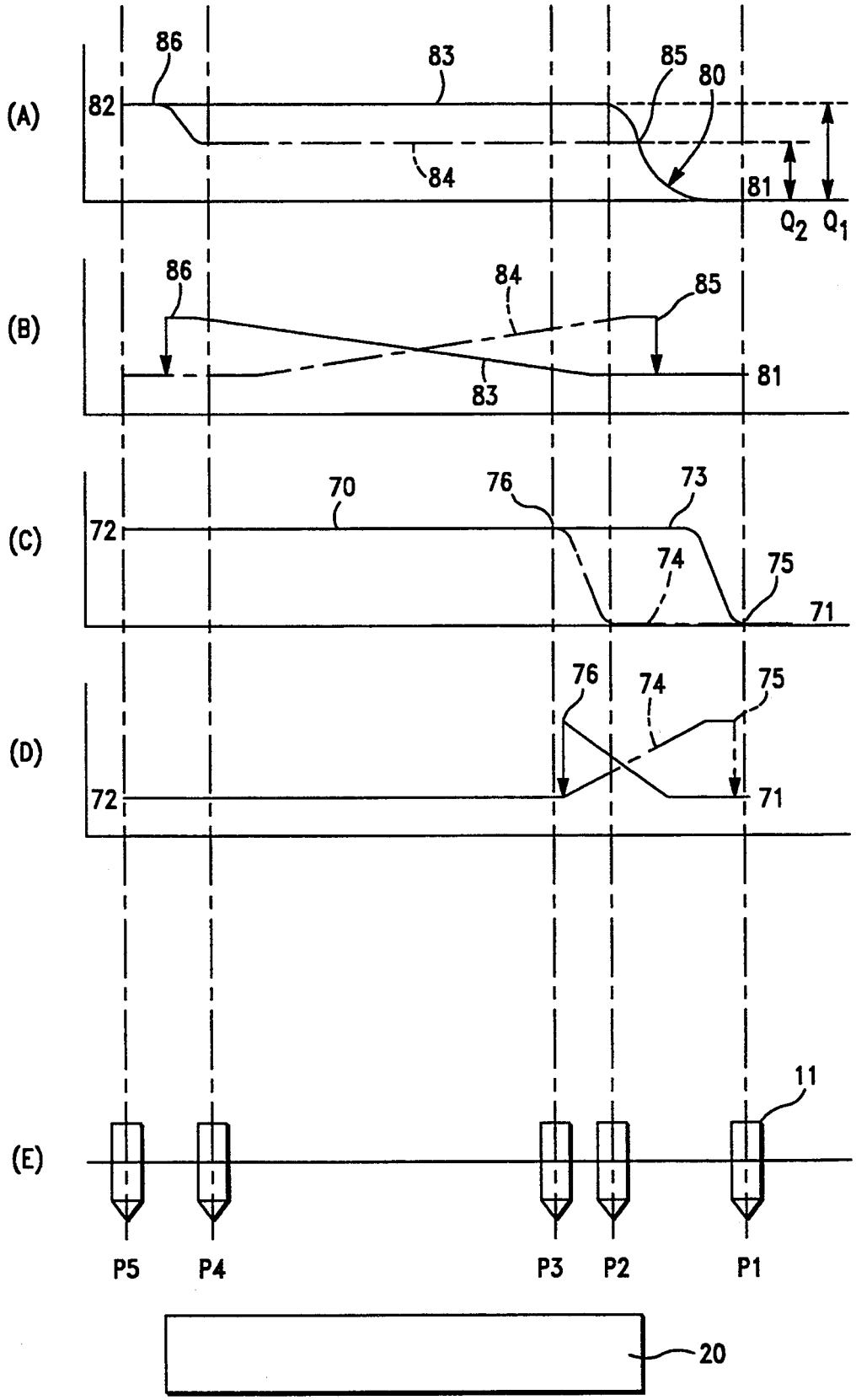
FIG. 8 shows cam line diagrams of the cam profiles for paper feeding and shifting.

A series of cam lines are shown in FIG. 8 illustrating paper feeding and shifting operations using cam profiles 80 and 70, respectively. FIG. 8(A) presents a graphical representation of the movement of paper feed cam profile 80 in a radial direction with respect to the position of print head 1. Therefore, FIG. 8(A) is based on the radial position of paper feed cam 40, as it is driven by belt gear 25 which also drives carriage 12 using belt gear 24 and timing belt 22. As previously discussed, the rotation of belt drive gear 25 has a one-to-one correspondence to the change in position for print head carriage 12. Since paper feed cam 40 is driven by belt drive gear 25, the degree or amount of rotation for cam 40 also has a one-to-one correspondence with the degree of rotation for belt drive gear 25. In FIG. 8(A), the cam profile that causes the least amount of movement in a radial direction is cam profile 84, which corresponds to a graphics mode profile, and the cam profile causing the largest radial motion is cam profile 83, which corresponds to character mode.

FIG. 8(B) presents a graphical representation of a relative change in depth at any position along the cam profile illustrated in FIG. 8(A). FIG. 8(C) provides a graphical representation of a relative distance moved by drive ratchet wheel 56, as pin 51 interacts with the profiles of cam profile 70. FIG. 8(D) presents a graphical representation of a relative change in the depth for cam profile 70. FIG. 8(E) illustrates the corresponding position of print head 11 relative to the respective values shown in FIGS. 8(A), 8(B), 8(C), and 8(D), and to the surface of paper 20.

Using the graphical representations of FIGS. 8(A), 8(B), 8(C), 8(D), and 8(E), an explanation of paper feeding operations used in character mode is presented. In this mode, paper movement is larger than it is for graphics mode; i.e., paper feed corresponding to a displacement Q1 of cam profile 83 from inner end 81 of paper feed cam profile 80 is performed. Also, print head 11 reciprocates back and forth between a standby position P1 and a left end position P4 which is generally opposite to the standby position of recording paper 20.

When print head 11 is in standby position P1, paper feed lever pin 61 is positioned at inner end 81, and shift lever pin 51 is positioned toward drive ratchet wheel 56 in profile 73. When head 11 moves to right side position P2 of recording paper 20, shift lever pin 51 traces deep groove 73 at connection point 75 and is pulled or directed toward the side of cam 40 opposite drive ratchet wheel 56, separating or dis-engaging drive ratchet wheel 56 from ratchet wheel 58. Therefore, since paper feed lever pin 61 moves along deeper cam profile 83 at connection point 85, paper feed lever 60 is rotated, but no torque is transmitted to paper feed shaft 90. For this reason, paper feeding or advancement is not performed even though paper feed lever 60 is rotated.

While in this state, print head 11 moves from right side position P2 to left side position P4 and performs printing. Print head 11 then reverses direction at left side position P4 and begins moving back toward position P2. At this point, paper feed lever pin 61 has not yet reached connection point 86, so that it moves back along cam profile 83. When the print head returns, shift lever pin 51 traces cam profile 74 which is deeper at connection point 76 of cam profile 70, for performing transmission shifting. Therefore, drive ratchet wheel 56 is released from the puling pressure of shift lever 53 and is instead pressed against ratchet wheel 58 by paper feed spring 54. In cam profile 83, paper feed lever pin 61 is displaced a distance Q1 from connection point 86, i.e., does not move to inner cam profile 84, toward inner end 81. Also, the torque resulting from displacement Q1 of paper feed lever pin 61 is transmitted to paper feed shaft 90 through paper feed lever 60, and paper feeding corresponding to character mode is performed.

In graphics mode, print head 11 moves between standby position P1 and graphics position P5. Graphics position P5 is situated farther to the left of position P4 of paper 20. Movement of the cam profiles from positions P1 to P5 occurs in the same manner as in character mode, so that further explanation is omitted here. On returning from position P5, paper feed lever pin 61 automatically selects the deeper cam profile 84 at connection point 86 and traces it. When the torque of paper feed lever 60 is transmitted to paper feed shaft 90 at connection point 76 of cam profile 70, displacement equivalent to a displacement Q2 of cam profile 84 is transmitted to paper feed shaft 90, and paper feeding is performed. Displacement Q2 is smaller than displacement Q1 since cam profile 84 is formed inside of cam profile 83, at a smaller radius. Therefore, the amount of paper fed in graphics mode is smaller than that for character mode. By changing the distance of the out and return strokes of print head 11 in this way, the amount of paper fed can be easily changed.

The cam profiles and timing relationships presented in FIGS. 8(A) and 8(C), clearly show that rotary motion being imparted by feed lever 60 is terminated completely before the transmission is dis-engaged by lever 53. That is, the transmission is not dis-engaged, or engaged, while shaft 90 is still being rotated, but only after it has stopped rotating for a minimum period of time. This arrangement prevents slippage or variations in shaft rotation which can be caused by switching the transmission before rotation has completely stopped, or to close to a change in rotation. Therefore, the interrelationship of the cam profiles provides very accurate paper feeding for the printer.

Figure 9:
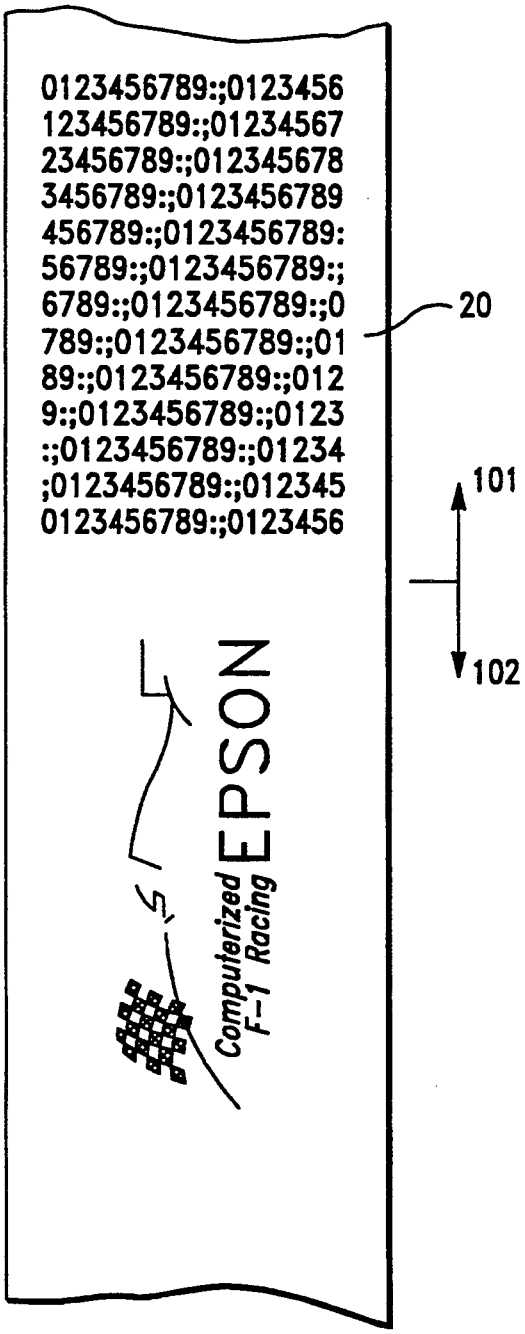
FIG. 9 illustrates recording paper after being printed on by the printer of FIG. 1.

Representative sample printing on recording paper 20 is illustrated in FIG. 9. For this example, print head 11 is configured with a dot pattern output of nine dots are arranged vertically. In a character mode 101, the line spacing is achieved by feeding recording paper 20 twenty dots (5.2 mm) at a time using cam profile 83. In a graphics mode 102, all 9 dots are used and recording paper 20 is fed twelve dots (3.2 mm) at a time in order to position the lines closer together.

A fast feed mode can also be used to feed recording paper 20 without any printing occurring. In the fast feed mode, print head 11 travels between standby position P1 and fast feed position P3. Movement for each of the elements or components of the printer as the head moves from position P1 to position P3 is the same as in character mode, and further detailed explanation is omitted here. Fast feed position P3 is located beyond connection point 76 of cam profile 70, and on returning from position P3 to P1, cam profile 74 is automatically selected. Therefore, the torque of lever arm 61, as determined by cam profile 83, is transmitted to paper feed shaft 90 and paper feeding is performed. Since position P3 is near the right side of paper 20, and the distance print head 11 travels in both directions is relatively short, paper feeding is performed faster than in normal character or graphics modes. In this manner, fast feed mode is possible by merely changing the distance print head 11 moves, or the relative positions to which it is moved.

While character mode, graphics mode, and fast feed mode have been accomplished in other printers, the printer of this invention allows the use of a single motor to drive both print head movement and paper feeding, thus, allowing the printer to be compact and lightweight. Furthermore, the amount of paper feeding can be changed by simply changing the distance the print head moves. This allows changes between character and graphics modes, etc., to be easily implemented by simple software commands to the motor control without added structure or command functions. By directly driving the paper feed mechanism from the carriage drive mechanism in this manner, fluctuations in print head motion can be alleviated and higher quality printing obtained.

Cam profiles used in prior printer was manufactured by machining a groove in the main guide shaft on a lathe, etc. The shaft is usually made from a metal rod material to ensure strength. However, since the paper feed cam of this invention is generally disc shaped, it can be easily formed using techniques such as injection molding, etc. In addition, since guiding the print head parallel to the platen requires lower force or strength, plastic or other lightweight material can also be used. Also, since the paper feed mechanism is separated from the printing mechanism, it can easily be built into the printer body, thus facilitating noise and dust reduction. Furthermore, since the transfer of torque from the paper feed lever to the paper feed shaft is controlled using a rotating element, noise otherwise generated by the interaction of ratchet claws moving in reverse, can be eliminated from the one-way clutch, thus making it possible to realize both a quiet, and compact and lightweight printer.

The above explanation was based on a printer that accommodated two types of paper feed, i.e., character mode and graphics mode, but three or more paper feed modes can be easily realized by increasing the number of cam profiles. Also, the paper feed cam need not be disc shaped, but rather it may be any shape on which cam profiles can be formed. Further, the cam profiles, paper feed lever, and shift lever may be any size or shape that will accommodate the desired amount of paper feeding or advancement, the force required, and any appropriate space limitations. Therefore, the levers can have a variety of shapes including arcuate or curved and include ridges or other structures for reinforcement or for coupling to other elements within the printer. Since the paper feed mechanism of the invention is driven directly from the carriage drive source, it can be easily formed using cams of various shapes suited to specific applications, sizes, etc., for the printer and without being affected by the shape of the carriage on which the print head is mounted as in prior art printers.

Figure 12:
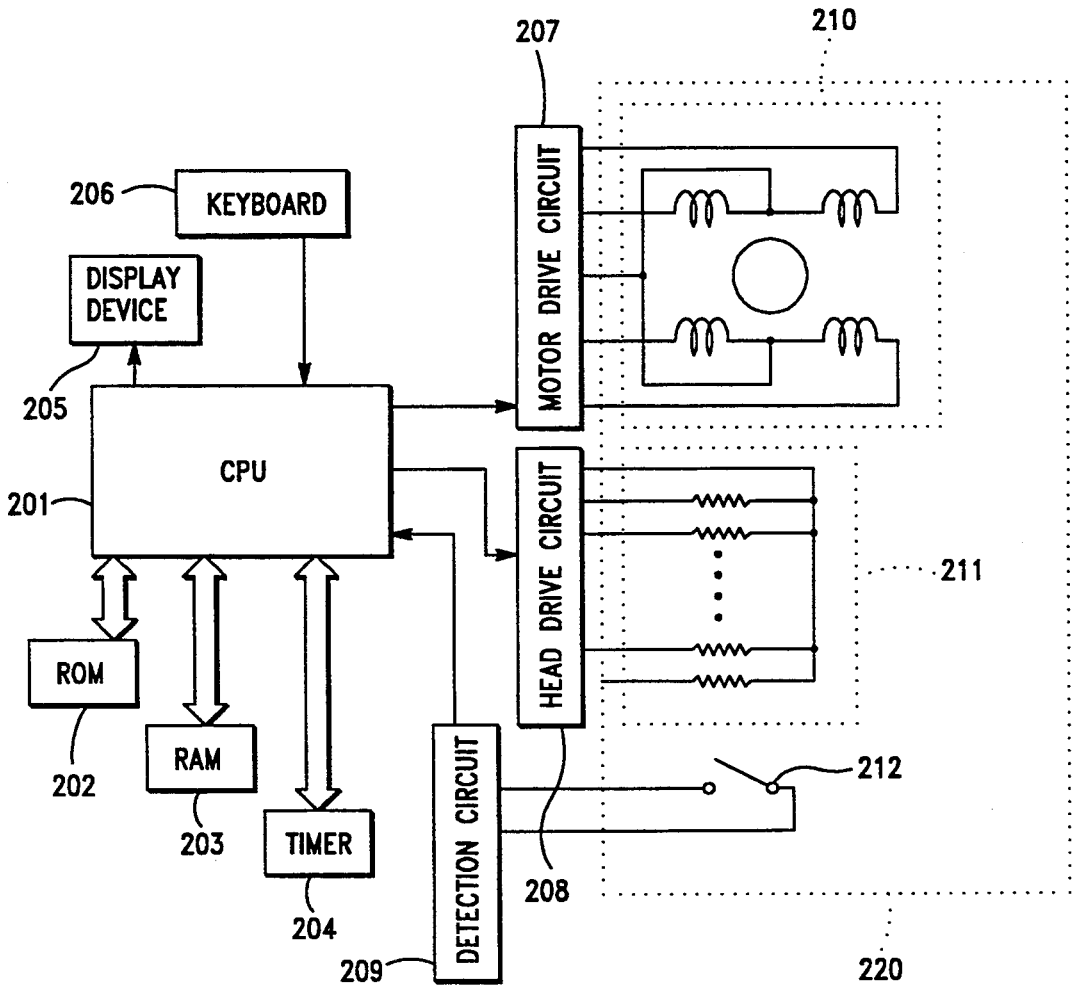
FIG. 12 illustrates a circuit block diagram for an electronic table-top calculator equipped with a printer according to the invention.

FIG. 12 illustrates a circuit block diagram for an electronic table-top calculator (simply referred to as calculator below) equipped with the printer of the invention and a drive control device that controls the printer.

A CPU 201 controls the entire calculator, which includes a ROM 202, a RAM 203, a timer 204, a display device 205, a keyboard 206, and a printer 220. CPU 201 is connected to communicate, commands and data, to printer 220 through an I/O port. A drive motor 210 is connected to a motor drive circuit 207 while a print head 211 is used to generate printed output and is connected to a head drive circuit 208, and a home position sensor 212, which detects the head position, is connected to a detection circuit 209. Each of these circuits, 207, 208, and 209, are in turn connected to CPU 201 for exerting control over their respective operation. An exemplary motor 210 is a stepper motor, and the angle of rotation or number of rotational steps can correspond in a 1-to-1 relationship with the lateral position of the print head when using the position detected by home position sensor 212 as a reference position. Therefore, it is possible to finely control the number of steps used by the stepper motor and the position of the print head or print head carriage according to the number of steps.

Figure 13:
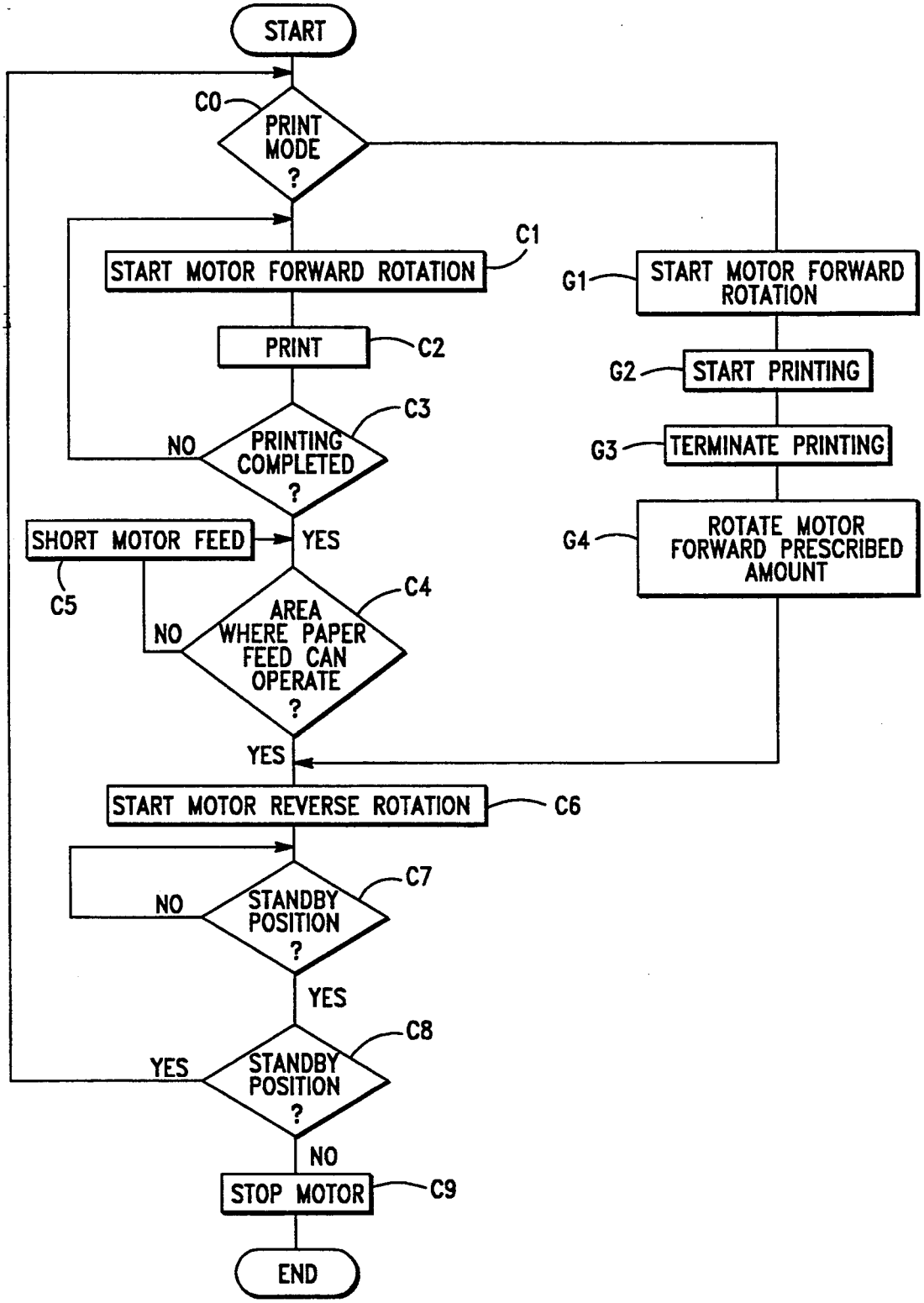
FIG. 13 illustrates a flowchart of steps useful for controlling the printer of FIG. 12.
Figure 14:
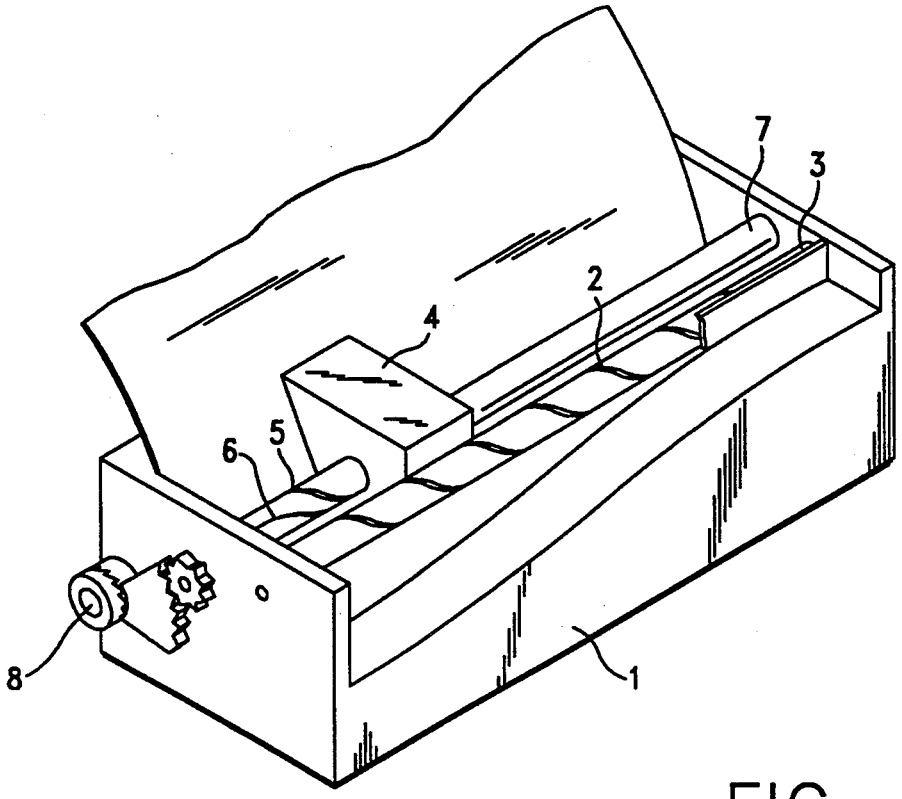
FIG. 14 illustrates a generalized perspective view of a printer of the prior art.
Figure 15:
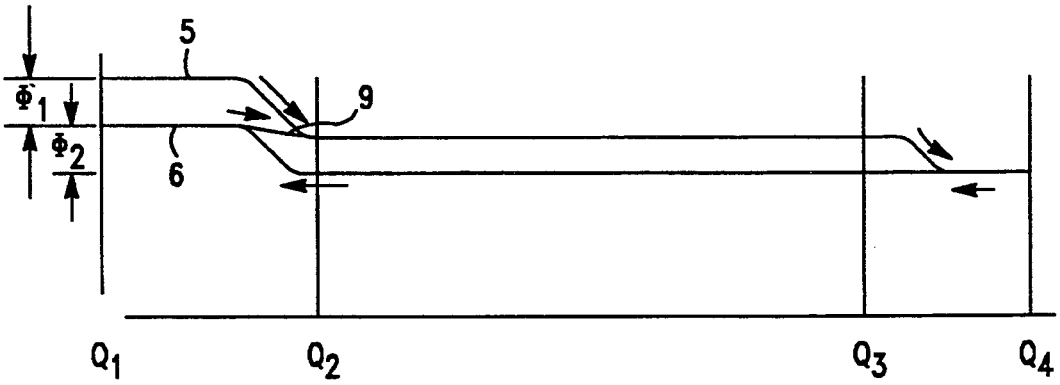
FIG. 15 illustrates a diagram of the paper feeding operation for the printer of FIG. 14.

One method for controlling the inventive printer in each of the printing modes discussed above, is explained further below in relation to FIGS. 8 and 13. Control steps for implementing character mode are illustrated in the flowchart of FIG. 13 and cam line diagrams for the paper feed mechanism are illustrated in FIG. 8. By rotating the motor forward in a step C1 after a character printing mode is determined to be present or selected in step C0, print head 11 moves over from the standby position P1. At this time, the home position sensor has already determined that print head 11 is in the prescribed position, and the CPU moves the print head from standby position P1 while determining the distance it has moved by counting the number of steps taken by the stepper motor. Until print head 11 arrives at printing start position P2 relative to paper 20, shift lever pin 51 traces the shallow grooved portion of cam profile 73 adjacent to connection point 75. During this time, drive ratchet wheel 56 and ratchet wheel 58 are disengaged so that paper feeding is not performed. When print head 11 moves to printing start position P2, the printing operation is started in a printing processing step C2. Whether or not all of the printing for the presently selected line is completed is then determined in a step C3. If printing is not completed, then processing returns to step C2 and the printing operation is continued until all printing for that line is completed.

The printing operation is performed while print head 11 moves along the guide shaft from printing start position P2 to a farthest position P4. When all of the printing to be performed on that line of head movement is completed, a determination is made in a step C4 as to whether or not print head 11 is positioned in the region along the guide shaft where the paper feed mechanism can be engaged to operate. That is, it is determined whether or not shift lever pin 51 has passed connection point 76. If print head 11 has not moved to the appropriate region where the paper feed mechanism can operate, then a short motor advance is performed in a step C5 and this step is repeated in combination with the decision processing of step C4 until head 11 has moved at least to position P3, which is in the region where the paper feed mechanism can operate. If print head 11 is positioned between positions P3 and P4, then processing proceeds to step C6 and the motor is rotated in reverse and print head 11 is moved back.

In a step C7, a determination is made as to whether or not print head 11 has arrived at standby position P1. If it has not arrived at this position, then movement of print head 11 is continued until it does arrive at the standby position P1. While print head 11 is moving back along main shaft 13, shift lever pin 51 traces along cam profile 74 which is deeper at connection point 76 than cam profile 73, thereby, deflecting pin 51 to follow profile 74. Therefore, drive ratchet wheel 56 and ratchet wheel 58 engage each other, and paper feed for one line is performed until print head 11 arrives at standby position P1 from position P3. If print head 11 has arrived at standby position P1, then in step C8 it is determined whether or not printing of the next line should continue. If printing is to be continued, then processing returns to step C1 and the control process described above is repeated. If printing of the next line is not to be performed, then the motor is stopped in a step C9 and one operation cycle is terminated.

As described above, if the position of print head 11 at the completion of printing is somewhere between positions P3 and P4, which is the region in which the paper feed mechanism can operate, then there is no need to always move print head 11 to the farthest position of the printer and print head 11 can be returned from its position at the completion of printing toward standby position P1, thus making it possible to eliminate unnecessary operation of the print head carriage.

In graphics mode, processing proceeds to step G1 and printing is started in a step G2, and continued until a prescribed number of dots have been printed, as determined in a step G3, after which the motor is rotated forward for a prescribed amount of time in a step G4, until the print head passes position P4 and arrives at position P5, where reverse rotation of the motor is commenced.

The position of the print head is processed by CPU 201, which uses a prescribed area in RAM 203 to count the number of steps performed by of the stepper motor and compare this with the number of steps previously stored in ROM 202.

Figure 10:
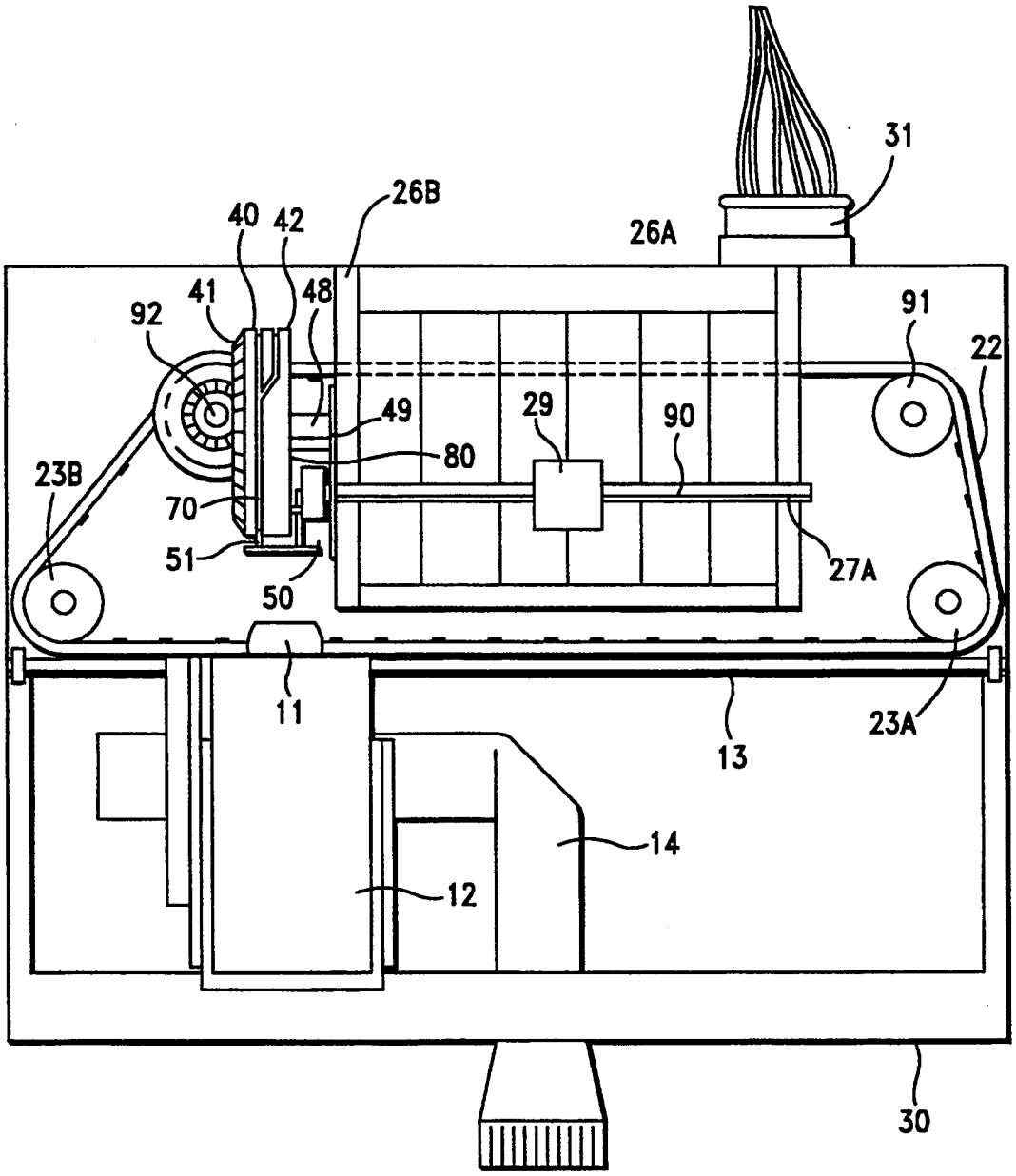
FIG. 10 illustrates a plan view of a second embodiment of the printer.

A second embodiment of a printer constructed and operating according to the principles of the invention is shown in FIG. 10. In the second embodiment, paper feed cam 40 and a belt drive gear 91 are disposed on opposite sides of platen 21 on printer base 30. The ability to locate paper feed cam 40 and the paper feed cam mechanism separately from belt drive gear 91, all of which require space, element positions can be optimized, the surface area of printer base 30 can be utilized more efficiently in some applications, and a more compact printer is facilitated. Since belt drive gear 91 and paper feed cam 40 are separated in this embodiment, a bevel-shaped gear 92 is positioned next to paper feed the cam 40 and has gear teeth that engage cam 40, and is rotated using timing belt 22.

The other components are substantially the same as previously discussed in relation to the first embodiment, and, therefore, are identified by the same numbers and further explanations are omitted here. Since operation in character mode, graphics mode, and fast feed mode is the same as in the first embodiment, further explanation of such operations are also omitted here.

Figure 11:
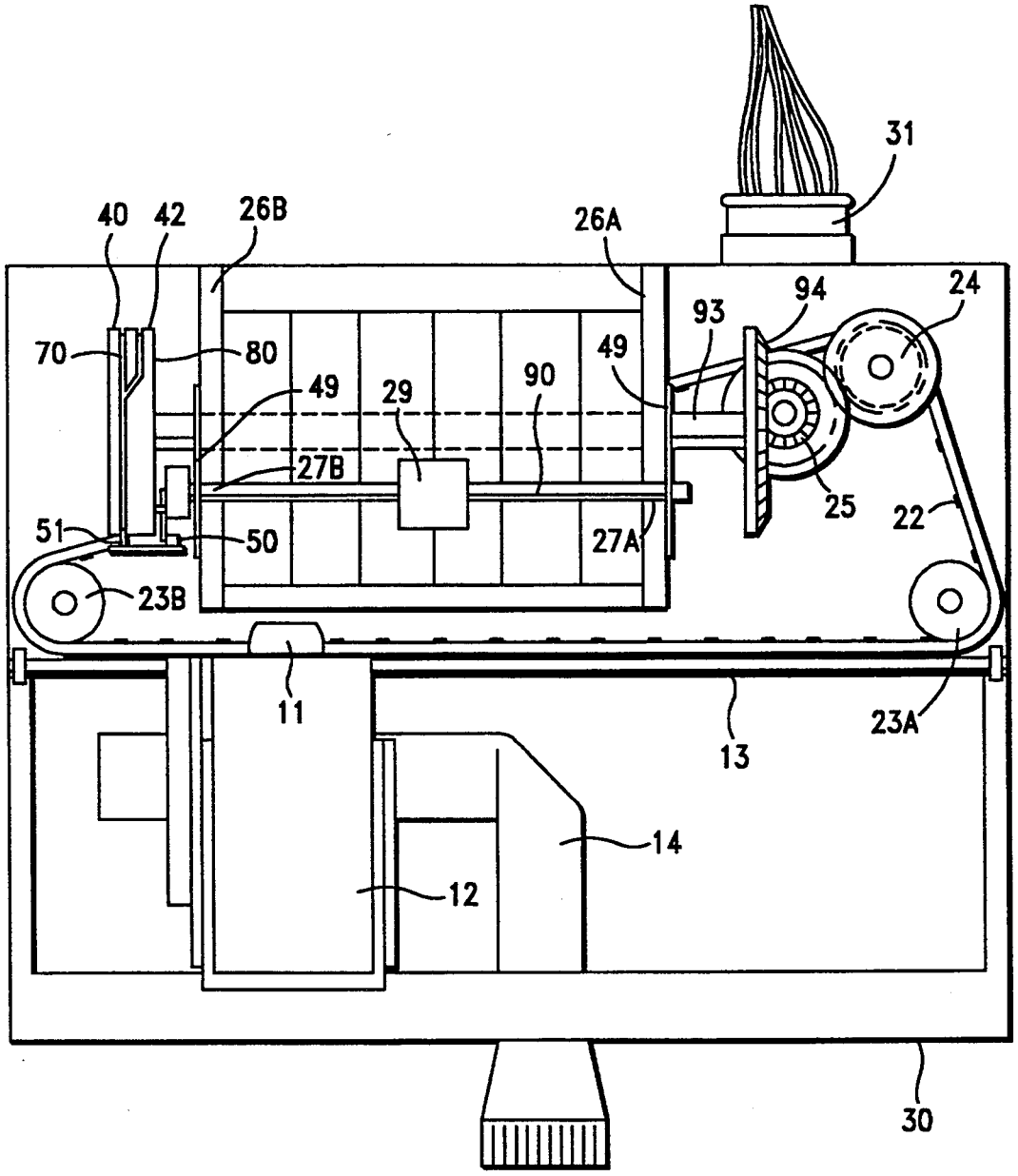
FIG. 11 illustrates a plan view of a third embodiment of the printer.

An outline of a third embodiment of a printer constructed according to the invention is shown in FIG. 11. In this embodiment, like the second embodiment, paper feed cam 40 and the mechanism for feeding paper, all of which require space, are mounted on printer base 30 in a location removed from belt drive gear 25. Therefore, the surface area of printer base 30 can be utilized efficiently, thus allowing the printer to be more compact.

In the third embodiment, bevel gear 94 is driven directly by belt drive gear 25, using the top mounted bevel-shaped gear portion. Bevel gear 94 is mounted on one end of a paper feed cam shaft 93 and paper feed cam 40 is mounted on the other, so that bevel gear 94 drives cam 40. The other components are substantially the same as previously discussed in relation to the first embodiment, and, therefore, are identified by the same numbers and further explanations are omitted here. Since operation in character mode, graphics mode, and fast feed mode is the same as in the first embodiment, further explanation of such operations are also omitted here.

As shown in the above three embodiments, the paper feed cam may be driven by a number of methods, that is, directly by a belt drive gear, which is in turn driven by the motor, or through a timing belt or paper feed cam shaft. A great deal of flexibility in printer design is provided by being able to independently locate cam 40 and the belt, gear, and motor drive components.

In the above embodiments, a groove-shaped cam profile is used, but the invention is not limited to this configuration or structure, and a protruding cam may also be used. It will be readily understood by those skilled in the art that cam profiles 70 and 80, among others, can also be realized using protruding ridges or similar guiding structures provided the pins 51 and 61 are also configured to interact with such guiding structures. That is, pins 51 and 61 might also be replaced by forked elements with forked ends which extend on both sides of, or encompass, a cam profile ridge, to prevent slippage or disconnection, as appropriate. In addition, cam 40 can be manufactured from a variety of materials corresponding to desired manufacturing practices and costs.

The inventive printer described above performs printing and paper feeding using a single motor by employing a cam mechanism driven directly by a carriage drive motor, and since the cam mechanism for paper feeding is isolated from the print head, several advantages are realized. Firstly, configuration of the cam or cams used to control paper feeding can be simplified, achieving a lower cost cam mechanism. Secondly, this drive configuration results in little fluctuation in the movement of the print head and making better quality printing possible. Thirdly, by using a contact release mechanism that is capable of controlling the direction of torque applied by the cam mechanism to the paper feed mechanism, unnecessary noise often generated by reverse cam rotation can be prevented. Fourthly, a high speed printer using simple controls can be offered that reduces unnecessary back and forth movement of the carriage. Fifthly, multiple paper feed pitches can be achieved using one motor and a simple means of motor control.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A printer that prints on an output medium by moving a print head mounted on a carriage adjacent to a platen supporting the medium, comprising:

a single reciprocatable motor drive source for generating a rotational force;

a drive gear coupled to said motor drive source comprising first and second coupling means for transferring the rotational force generated by said motor drive source;

carriage reciprocation means coupled to said first coupling means of said drive gear for reciprocating the print head carriage laterally across the output medium adjacent to the platen;

paper feeding means for feeding the output medium past said print head;

rotary transfer means coupled to said second coupling means of said drive gear comprising a cylindrical cam wheel coupled to said second coupling means of said drive gear having a first preselected cam profile formed on one face surface thereof and one first cam follower lever, said rotary transfer means being configured to vary the relative magnitude of rotation transferred in response to reciprocating motion for said motor drive source; and transmission means coupled to said rotary transfer means and said paper feeding means, said first cam follower lever being coupled between said cam wheel and said transmission means and configured to interact with said first cam profile so as to rotate about a fixed axis and transfer rotary motion of at least two different magnitudes to said transmission means, said transmission means for transferring rotation in one preselected direction to the paper feeding means.

2. A printer that prints on an output medium by moving a print head mounted on a carriage adjacent to a platen supporting the medium, comprising:

a single reciprocatable motor drive source;

carriage reciprocation means coupled to said drive source for reciprocating the print head carriage laterally across the output medium adjacent to the platen;

paper feeding means for feeding the output medium past said print head;

rotary transfer means coupled between said drive source and paper feeding means for transferring rotary motion to said paper feeding means in synchronization with reciprocating motion of said motor, being configured to vary the relative magnitude of rotation transferred in response to reciprocating motion for said motor drive source; and transmission means connected between said rotary transfer means and said paper feeding means for transferring rotation in one preselected direction to the paper feeding means.

wherein said rotary transfer means comprises:

at least one first cam coupled to said drive source having at least two preselected cam profiles having different cam follower deflection characteristics, said cam being indirectly coupled to said print head; and at least one first cam follower means connected in series between said first cam and said transmission means for interacting with said cam profiles so as to transfer rotary motions of at least two different magnitudes through said transmission means.

3. The printer of claim 2 wherein said first cam follower means comprises a rotating drive member that rotates back and forth in response to a reciprocating action of said first cam.

4. The printer of claim 2 wherein said first cam has at least two first cam profiles and is configured such that one of two paper feed pitches of differing paper feed amounts are selected by selecting one of the first cam profiles in response to the amount of rotation of said motor drive source.

5. The printer of claim 4 wherein said rotary transfer means comprises:

a second cam profile formed in a disc surface of a cylindrical cam wheel; and a paper feed lever driven in accordance with the cam second profile so as to rotate about a preselected axis and configured such that rotating action of said paper feed lever member is selectively transmitted to the transmission means.

6. The printer of claim 1 wherein said transmission means comprises:

a rotating drive element coupled to said rotary transfer means;

a rotated coupler element connected to said paper feeding means;

biasing means for engaging said rotating drive element and said rotated coupler element in physical rotating contact with each other; and contact release means for disengaging said rotating drive element and said rotated coupler element from contact in response to preselected movement of said drive source.

7. The printer of claim 1 wherein said motor comprises a stepper motor.

8. The printer of claim 1 wherein said carriage reciprocation means comprises a belt-pulley mechanism.

9. A printer that prints on an output medium by moving a print head mounted on a carriage adjacent to a platen supporting the medium, comprising:

a single reciprocatable motor drive source;

carriage reciprocation means coupled to said drive source for reciprocating the print head carriage laterally across the output medium adjacent to the platen;

paper feeding means for feeding the output medium past said print head;

rotary transfer means coupled between said drive source and paper feeding means for transferring rotary motion to said paper feeding means in synchronization with reciprocating motion of said motor, being configured to vary the relative magnitude of rotation transferred in response to reciprocating motion for said motor drive source; and transmission means connected between said rotary transfer means and said paper feeding means for transferring rotation in one preselected direction to the paper feeding means, wherein the rotary transfer means comprises:

at least one cylindrical cam wheel coupled to said drive source having at least two first preselected cam profiles formed on one face surface thereof having at least partially different radial variant paths; and at least one first cam follower lever coupled between said cam wheel and said transmission means and configured to interact with said first cam profiles so as to rotate about a fixed axis and transfer rotary motion of at least two different magnitudes to said transmission means.

10. The printer of claim 9 wherein the first cam profiles comprise generally spiral shaped cam follower guidance channels.

11. The printer of claim 9 wherein said transmission means comprises a cam mechanism coupled to said motor drive source.

12. The printer of claim 11 wherein said cam mechanism comprises a second cam profile defined by a groove formed in the cylindrical surface of said cylindrical cam wheel, and a second cam follower responsive to said groove and configured such that said rotary transmission means is selectively coupled to and decoupled from said paper feeding means in accordance with said shift lever.

13. The printer of claim 11 wherein said cylindrical cam wheel and said cam mechanism comprise a single cylindrically shaped cam wheel with said first cam profiles formed on both a side cylindrical surface which engage said first cam follower and on a disc surface which engage a second cam follower.

14. The printer of claim 13 wherein the first cam profiles comprise generally spiral shaped cam follower guidance channels.

15. The printer of claim 14 wherein:

said guidance channels comprise at least first and second depth variable guidance channels, said first depth variable guidance channel having a generally smaller radius than said second depth variable guidance channel and said first and second depth variable guidance channels intersect at two points along their respective lengths so as to share a common path along a preselected portion of their lengths; and said first cam follower comprises a spring biased pin which traces said guidance channels in response to depth variations.

* * * * *